US010161091B2

(12) United States Patent
Gunter

(10) Patent No.: US 10,161,091 B2
(45) Date of Patent: Dec. 25, 2018

(54) LOCATION MARKER

(71) Applicants: Shaun Hartley Gunter, George (SA); David Wiseman, Honeydew Manor, Roodepoort (SA)

(72) Inventor: Shaun Hartley Gunter, George (SA)

( * ) Notice: Subject to any disclaimer, the term of this patent is extended or adjusted under 35 U.S.C. 154(b) by 0 days.

(21) Appl. No.: 15/620,160

(22) Filed: Jun. 12, 2017

(65) Prior Publication Data

US 2018/0320326 A1 Nov. 8, 2018

(30) Foreign Application Priority Data

May 5, 2017 (SA) ..... 2017/03100

(51) Int. Cl.
*E01F 9/654* (2016.01)
*E01F 9/688* (2016.01)
*E01F 9/692* (2016.01)
*E01F 9/627* (2016.01)

(52) U.S. Cl.
CPC ..... *E01F 9/654* (2016.02); *E01F 9/629* (2016.02); *E01F 9/688* (2016.02); *E01F 9/692* (2016.02)

(58) Field of Classification Search
CPC . E01F 9/012; E01F 9/654; E01F 9/688; E01F 9/692; E01F 9/627; E01F 9/929
USPC ..... 116/63 P, 63 R
See application file for complete search history.

(56) References Cited

U.S. PATENT DOCUMENTS 1,228,615 A * 6/1917 Stafford ..... E01F 9/629 116/173
2,002,756 A * 5/1935 Segelhorst ..... E01F 9/688 116/63 P
2,123,420 A * 7/1938 Hiser ..... E01F 9/688 248/160
2,521,496 A * 9/1950 Worhun ..... G09F 17/00 116/173
2,646,638 A * 7/1953 Peterson ..... E01F 9/688 116/173
3,386,409 A * 6/1968 Dawson ..... E01F 9/688 116/63 P
4,117,455 A * 9/1978 Cervantes ..... E01F 9/615 116/63 P
4,394,843 A * 7/1983 Ediriwira ..... E01F 9/688 116/63 P
4,739,302 A * 4/1988 Kinard ..... E01F 15/003 116/63 C (Continued)

FOREIGN PATENT DOCUMENTS

CN 206635681 U * 11/2017 ..... E01F 9/654
EP 1273710 A1 * 1/2003 ..... E01F 9/688
JP 01239209 A * 9/1989 ..... E01F 9/688
JP 2010189878 A * 9/2010 ..... E01F 13/02

(Continued)

*Primary Examiner* — R. A. Smith

(74) *Attorney, Agent, or Firm* — Law Offices of Steven W. Weinrieb

(57) ABSTRACT

A location marker is disclosed, apt for use at work sites, crime scenes, sporting events, or as a traffic control or warning device. The location marker consists of a body having and at least one upright and a base supporting the upright from below, the upright being provided with an alerting feature to alert an observer or intended recipient about a message the alerting feature intends to convey; the body including biasing means configured to urge the upright into an erect orientation after being momentarily knocked over such that the alerting feature is almost always displayed, with the upright in the erect configuration.

20 Claims, 7 Drawing Sheets

(56) References Cited

U.S. PATENT DOCUMENTS

| | | | | | |
|---|---|---|---|---|---|
| 4,766,686 | A * | 8/1988 | Glasener | G09F 7/22 | 40/602 |
| 5,487,619 | A * | 1/1996 | Winebrenner | E01F 9/20 | 256/13.1 |
| 6,053,658 | A * | 4/2000 | Gibson, Jr. | E01F 9/629 | 116/63 P |
| 6,247,424 | B1 * | 6/2001 | Huang | E01F 13/02 | 116/63 C |
| 2012/0234228 | A1 * | 9/2012 | Kuo | E01F 9/654 | 116/63 C |

FOREIGN PATENT DOCUMENTS

| | | | | | |
|---|---|---|---|---|---|
| JP | 3185760 | U * | 9/2013 | E01D 9/012 | |
| KR | 20020069423 | A * | 9/2002 | E01F 9/627 | |
| KR | 20040084001 | A * | 10/2004 | E01F 9/012 | |

* cited by examiner

LOCATION MARKER

FIELD OF THE INVENTION

This invention relates to a marker and more particularly relates to a location marker which is freestanding and may be used alone or with additional warning or cautionary devices at dangerous work sites, crime scenes, sporting events, or as a traffic control or warning device.

BACKGROUND TO THE INVENTION

Free standing location markers usually consist of a supporting base onto which an upright is mounted.

The upright may for example take the form of a cone shaped collar, an elongate tubular member with a hollow centre, or a sheet of plastic or metal that can be curved to fit a receiving opening in the base. Furthermore, location markers are usually provided with a reflective area to alert oncoming traffic or pedestrians of potentially dangerous conditions or to indicate marked-off areas.

While most location markers are manufactured from a yieldable material to withstand a fall or external impact caused, for example, by a collision with a vehicle, the main purpose of a location marker is to convey a message to a person approaching the marker. Usually, such message can only be effectively conveyed when the location marker is in its upright position, in which case the reflective area is correctly displayed and in sight of the observer or intended recipient. Accordingly, recovery of a location marker to its original orientation and shape, after impact, is quite important.

Often, however, strong winds, people and motor vehicles knock over or displace location markers from their intended positions causing them to be not as effective in conveying the intended message to the recipient.

It is thus an object of this invention to provide a free-standing location marker, which addresses, at least in part, the abovementioned shortcomings.

SUMMARY OF THE INVENTION

In broad terms, this invention provides a free standing location marker comprising a body having and at least one upright and a base supporting the upright from below, the upright being provided with an alerting feature to alert an observer or intended recipient about a message the alerting feature intends to convey; the body including biasing means configured to urge the upright into an erect orientation after being momentarily knocked over such that the alerting feature is almost always displayed with the upright in the erect configuration.

The invention also provides for the base to comprise the biasing means. The base is typically square, when viewed in plan.

Preferably, but not necessarily, the biasing means comprises a base, heavier than the upright and; one or more yieldable projections, projecting outwardly and away from the base, the one or more projections being shaped and configured to urge the upright into an erect orientation after being momentarily knocked over.

Preferably, the one or more projections are in the form of a plurality of legs which are secured and extend radially outward and upward relative to a plane of the base and from corners of the base, the legs cooperating with beveled edges which define a perimeter for the base.

Still further there is provided for the alerting feature to be a distinguishable and of clearly visible colour, either integrally formed with or applied to an outer surface of the upright; or a retroreflective strip applied onto said upright.

There is also provided for the upright and the base to be manufactured from a resilient material. In an embodiment, the upright, base, and legs are integrally formed and of unitary construction. Alternatively, the legs are mountable to the base after separate manufacturing thereof.

In an embodiment, the upright comprises a frustoconical shape with a hollow interior defined between the side walls of the upright, which hollow interior extends along a centerline of the upright.

In an embodiment, a lower end of the upright is provided with engagement means to permit an interference fit with said lower end and receiving means provided on the base to operatively receive the upright.

In accordance with a further embodiment of the invention there is provided for the base to comprise a semi-spherical member having an outer face which is rounded and operatively in contact with the ground; and an inner face with receiving means to receive the upright.

In accordance with this further embodiment of the invention there is provided for the upright when secured to the semi-spherical member by way of the receiving means to form the body, which is biased to remain in an upright position relative to the ground. The base in the form of the semi-spherical member is heavier than the upright.

There is provided for the receiving means to include at least one annular groove defined within the semi-spherical member.

Also in accordance with this further embodiment of the invention there is provided for the semi-spherical member to include stabilizing means such as at least one resilient limb operatively mounted to, and radially extending from, the semi-spherical member towards the ground so that angular displacement of the upright relative to the ground is countered by the resiliency of the at least one limb such that the upright returns to its upright biased position relative to the ground immediately after being angularly displaced.

Also in accordance with this further embodiment of the invention three limbs are provided, longitudinal axes of which are equiangular relative to one another, and equal in length. Alternatively, the at least one resilient limb is in the form of a cross-like support, locatable below the semi-spherical member, with axes extending at right angles relative to each other.

There is also provided, in an alternative embodiment of the invention, for the semi-spherical member to have a weighted centre of gravity provided either by inserting a weighted object into a chamber defined within the semi-spherical member or by integrally forming the semi-spherical member, during manufacturing, with a weighted centre of gravity.

There is further provided for the upright to have a tubular shape, alternatively, a semi-circular vane similar to standard existing delineators.

BRIEF DESCRIPTION OF THE DRAWINGS

The invention is now described by way of example with reference to the accompanying non-limiting diagrammatic drawings and photographs. In the drawings and photographs.

DETAILED DESCRIPTION OF THE DRAWINGS

Figure 1:
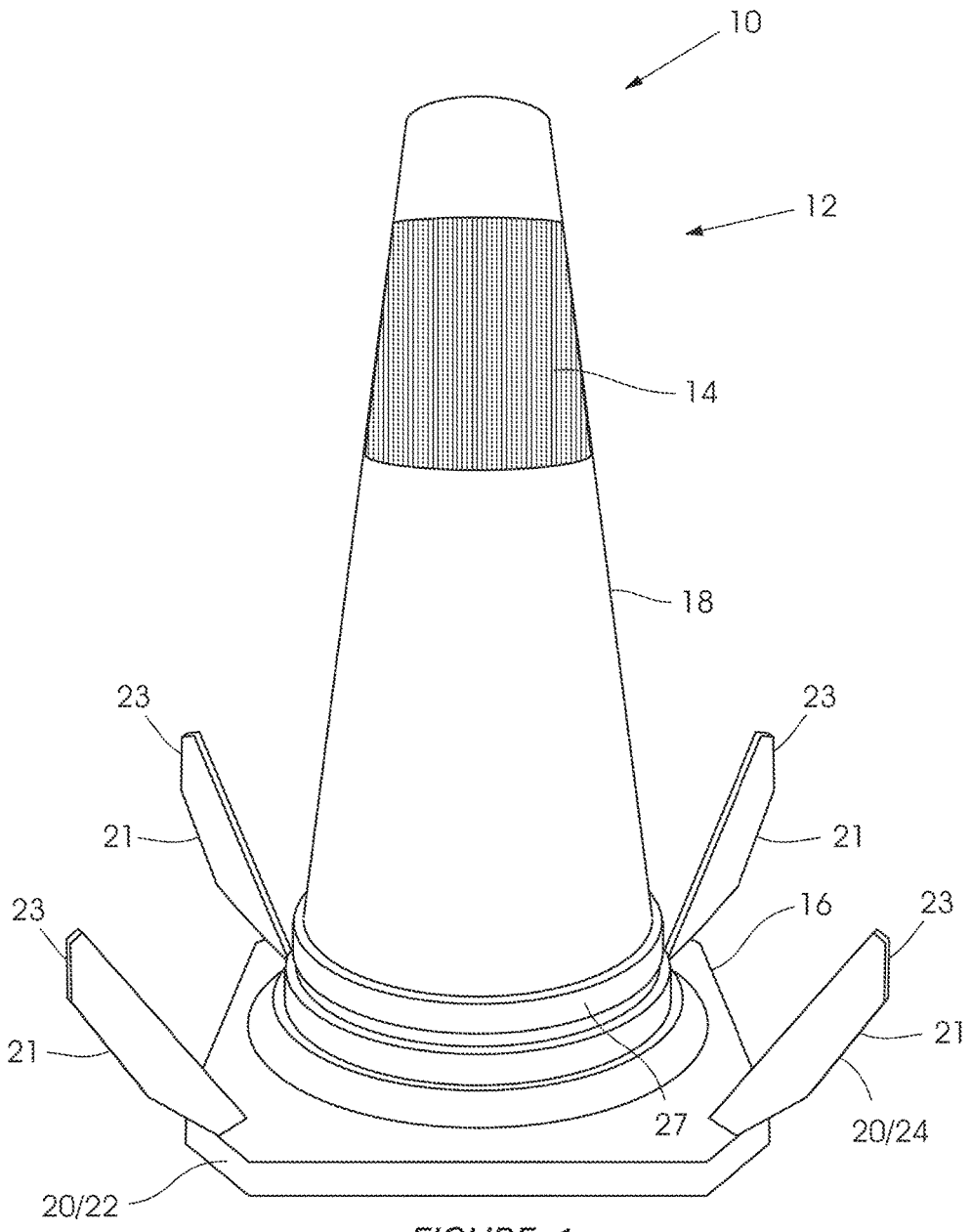
FIG. 1 shows a perspective view of a free-standing location marker, in accordance with a first embodiment of the invention.
Figure 2:
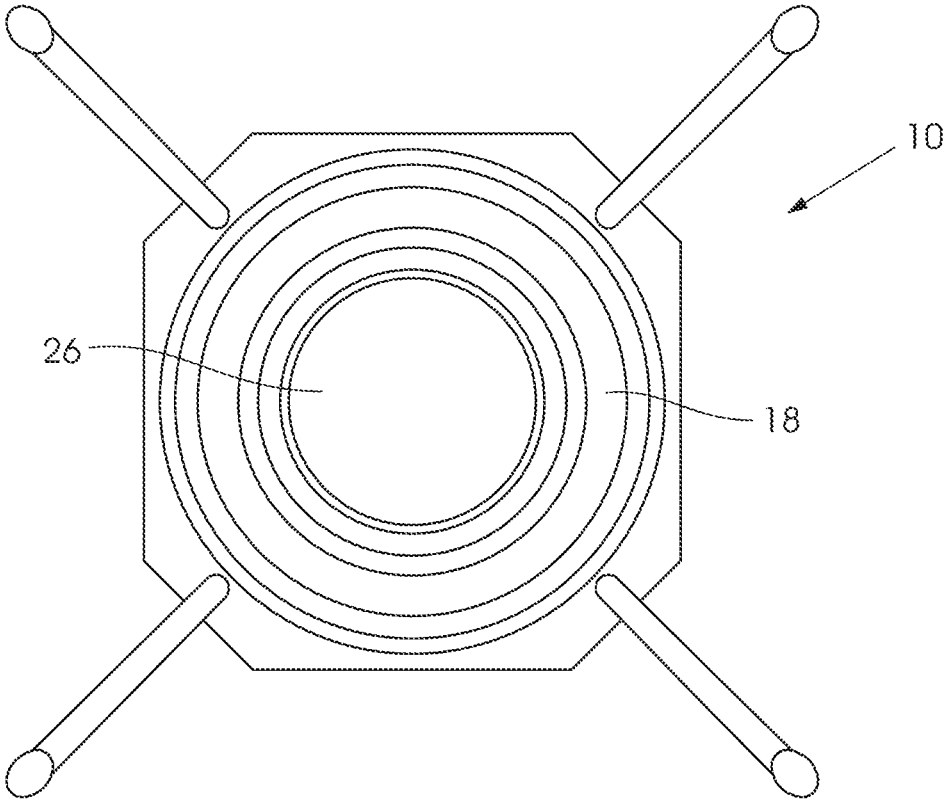
FIG. 2 shows plan view of the location marker of FIG. 1.
Figure 3:
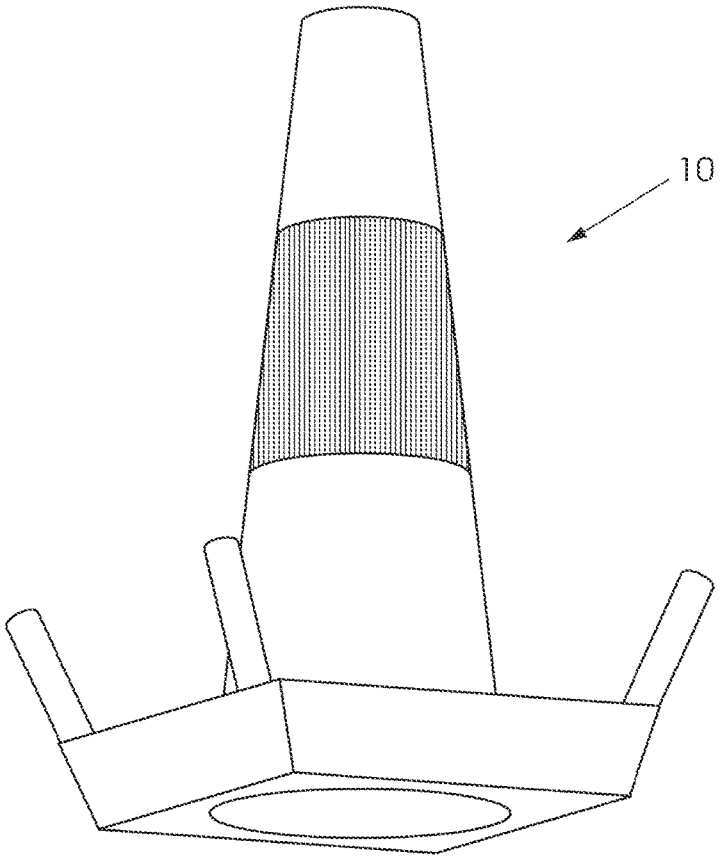
FIG. 3 shows a perspective view of the location marker of FIG. 1 after being knocked over by a gust of wind or by a vehicle.

In the drawings, like numerals generally indicate like components, unless otherwise indicated.

In FIGS. 1 to 4 and 5 to 9, reference numerals 10 and 100 respectively refer to a location marker which is freestanding and may be used alone or with additional warning or cautionary devices at dangerous work sites, crime scenes, sporting events, or as a traffic control or warning device. The location marker 10,100 is mostly used to channelize traffic, whether it is motor vehicle traffic or aviation traffic on ground level at airports.

The location marker 10, as shown in FIGS. 1 to 4 of the drawings, is a free-standing marker manufactured to be yieldable thereby to take a certain degree of strain or impact, caused either by pedestrians or by vehicles knocking over the marker 10. Upon impacted, the location marker 10 momentarily falls over laterally or to one of its sides, whereafter it quickly recovers to its original shape and upright or erect orientation. Although this is a great benefit, the location marker 10 also, and perhaps more importantly, remains fully functional as an alerting feature 14, which is provided thereon, is fully visible within a second or so after impact. Similarly, after being blown over by strong gusts of wind, the marker 10 remains effective as a location marker indicating or alerting a pedestrian or vehicle driver about a certain condition ahead or in the vicinity of the location marker 10.

As depicted in the drawings, the location marker 10 has a body 12 with the alerting feature 14 provided thereon. The alerting feature 14 may take various patterns, shapes and configurations, but importantly, is a distinguishable and clearly visible in colour so that oncoming traffic and/or pedestrians can be alerted about a certain condition when they approach the erect or upright marker 10.

Although FIG. 1 shows the alerting feature or colour 14 as an adhesive retroreflective strip, the alerting feature or colour 14 may in other embodiments of this invention also be integrally formed with or otherwise applied to an outer surface of the body 12. For example, such alerting feature or colour 14 may even comprise a mere painted area applied onto the body 12.

Figure 4:
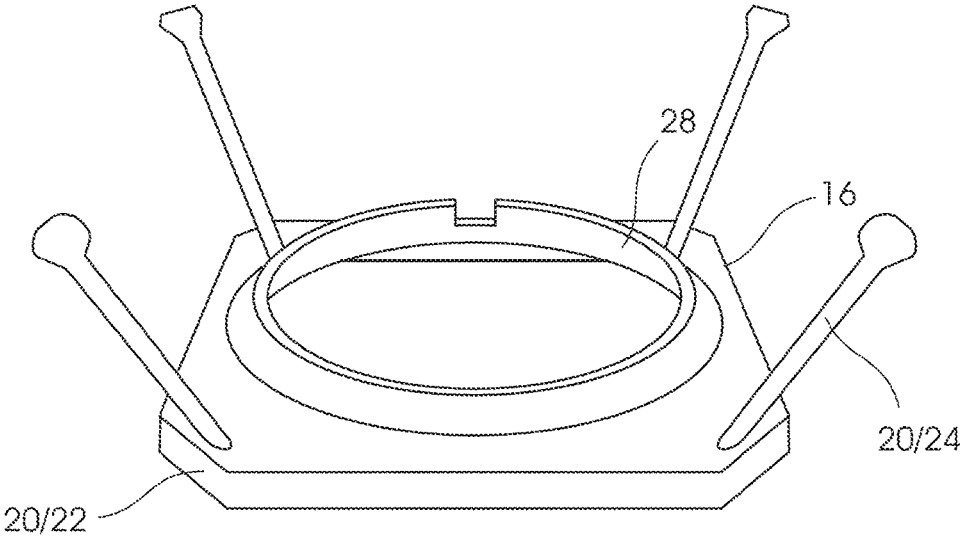
FIG. 4 shows a perspective view of a base for the location marker of FIG. 1.

It will be appreciated that the body 12 is typically, but not necessarily, manufactured from a resilient or flexible material such as recycled plastic or rubber. When manufactured, the body 12 is typically integrally formed in a mould to form the body 12. Alternatively, a base portion 16 and a frusto-conical shaped upright portion 18 thereof may be mounted or connected to each other after separate manufacturing processes, typically plastics moulding processes. As shown in FIG. 4, the base 16 is typically square, when viewed in plan-view, whereas the upright 18 is provided with a hollow interior 26 defined between the side walls of the upright 18, as best shown in FIG. 4.

The hollow interior 26 extends along a centerline of the upright 18 all along its length. Furthermore, the upright 18 consists of a proximal end or lower end in proximity to the base; and a distal end or upper end opposed thereto. The proximal end or lower end is provided with engagement means to permit an interference fit with receiving means provided on the base 16 to operatively receive the upright 18. It is however anticipated that the base 16 and upright 18, in other non-shown embodiments of the invention, may be of unitary construction and integrally formed as opposed to the separate but connectable base 16 and upright 18.

Biasing means 20 forms part of the base 16, but may also in other embodiments of the invention form part of for example the proximal or lower end of the upright. As such, it is envisaged that the biasing means 20 may take several shapes and configurations, which all function similarly in that they are biased to keep the upright in an erect condition or orientation. In so doing, a longitudinal axis of the upright 18 remains near always in register with the ground, apart from momentarily being displaced towards a lateral side of the upright 18 after being impacted upon by an external object, such as a vehicle.

In the example embodiment depicted in FIGS. 1 to 4, the biasing means 20 include: the base 16, which is provided with a mass making it heavier than the upright 18; beveled edges 22, defining a perimeter for the base 16; and a plurality of legs 24, which are secured to and extend radially outward and at a near 45° angle relative to corners of the base 16.

The upright 18, base 16, and legs 24 may be integrally formed and of unitary construction. Alternatively, the legs 24 are mountable to the base 16 after separate manufacturing thereof. In the latter case, the legs will be configured to fit into designated slots provided in the base.

These legs 24 are preferably also resilient and act to counter angular displacement of the upright 18 relative to the ground such that the upright 18 returns to its upright or erect orientation relative to the ground immediately after being angularly displaced because of a possible strong gust of wind or collision with a vehicle or person. Moreover, the longitudinal axes of these legs 24 are typically spaced equiangular relative to one another, and equal in length. It will be appreciated that the beveled edges 22 of the base 16 also contributes as biasing means, biasing the body 12 to its upright position any time it is displaced from the upright orientation or position.

As depicted in the Figures, each leg 24 defines an outer edge 21 along which contact with the ground is made when the location marker 10 is momentarily knocked over and during return of the upright 18 to an erect orientation.

It will be appreciated that the outer edge 21 may be slanted sections as shown in FIG. 1, but it is envisaged that curved sections may also function suitably to assist in biasing the location marker 10 upright after being knocked over. The outer edge 21 terminates in a tip 23 configured to touch the ground when an extremity or upper end of the upright 18 touches or contacts the ground or a surface on which the location marker 10 usually stands. The tip 23 is also pointed in such a direction such that it assists in urging the location marker 10 upright after being knocked over.

It is further anticipated that the base 16 will have a mass between about 2.5 kg and about 8.5 kg. When compressed rubber is utilized the mass of the base 16 is typically between 5 kg and 8 kg.

An optional, preferably, circular shaped, add-on fitment 27 is releasably secured to a centre portion of the base 16. The add-on fitment 27 is typically configured to snuggly receive and locate, preferably by rotation fitment or via a click-in mechanism, a smaller or larger dimensioned upright cone 18. In so doing, the dimensions of the base 16 remain unchanged as the add-on fitment 27 is utilized to decrease or increase the diameter of the base opening so that said opening can receive and locate a smaller or larger sized upright cone 18.

A lower end or proximal end of the upright 18 is provided with engagement means (not shown), but typically a circular extending rim or tongue, to permit an interference fit between the rim or tongue and receiving means or complementary shaped groove 28, provided on the base 16, thereby to operatively receive the upright 18.

Referring to FIGS. 5 to 9, a further embodiment of the invention is shown.

Figure 5:
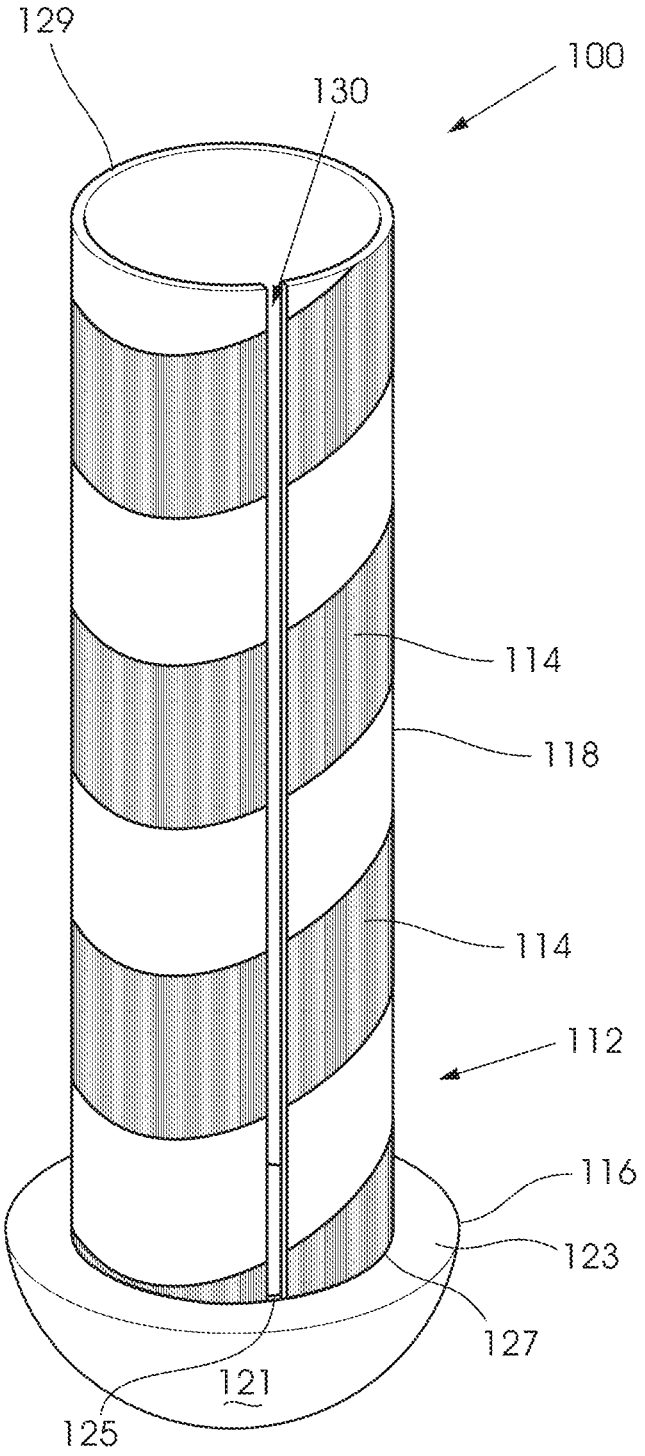
FIG. 5 shows a front perspective view of a free-standing location marker in accordance with a second embodiment of the invention.

In FIG. 5 the location marker 100 is in the shape of a bollard-type marker having a body 112 comprising a base 116 in the form of a semi-spherical member opposite an upright 118. This base, instead of being shown as a rounded semi-spherical member 116, may obviously also be square in other embodiments of the invention.

Figure 6:
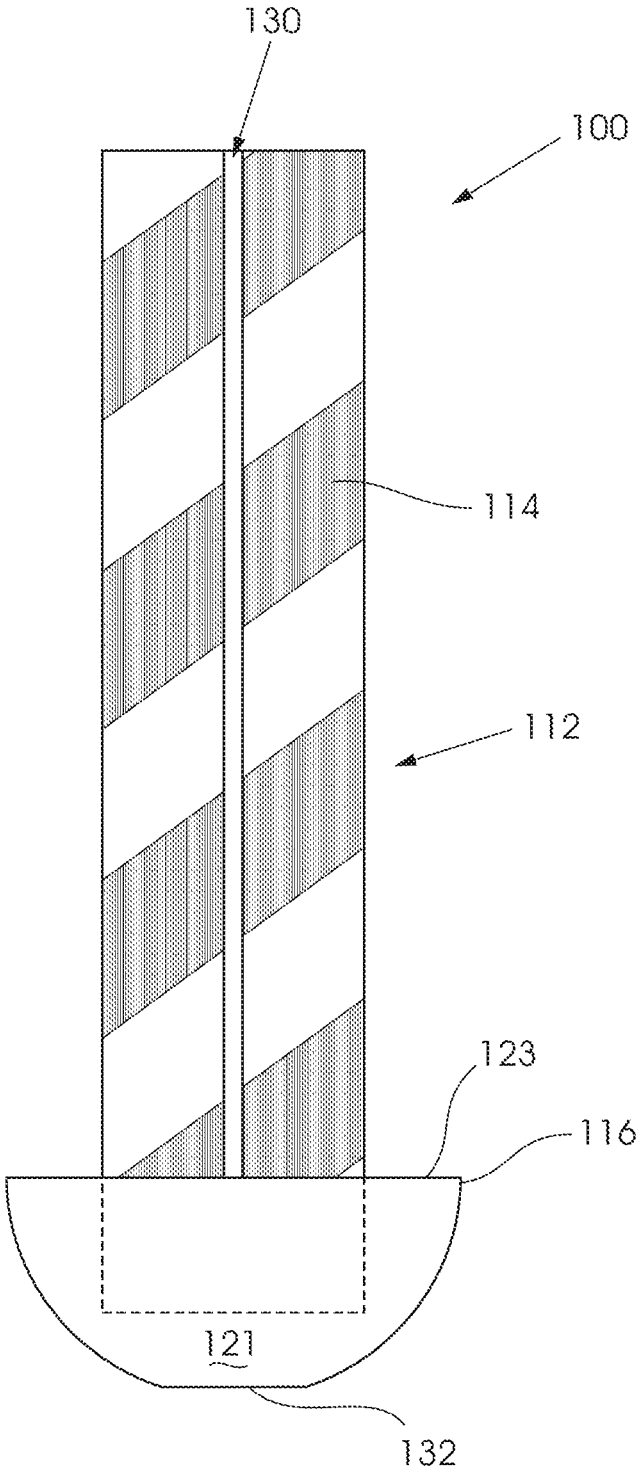
FIG. 6 shows a side view of the location marker of FIG. 5.
Figure 7:
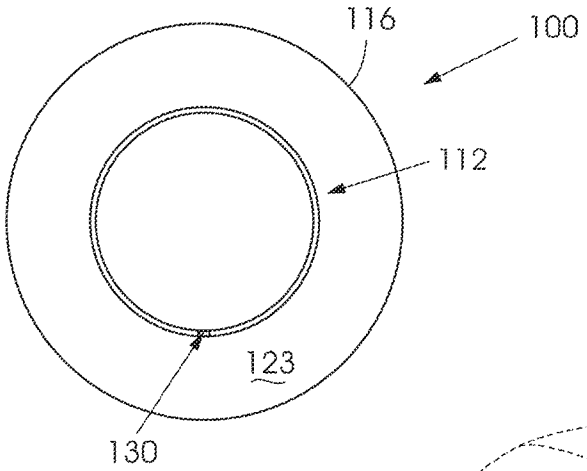
FIG. 7 shows a plan view of the location marker of FIG. 5.
Figure 8:
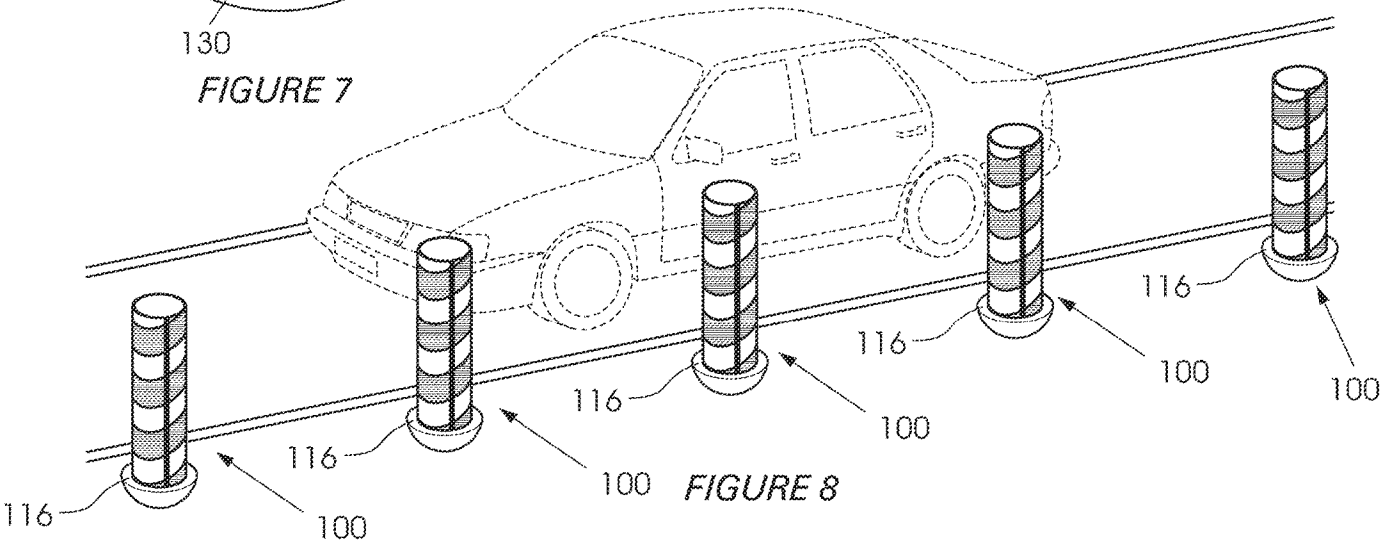
FIG. 8 shows a perspective view of a plurality of location markers of FIG. 5 used alongside a road.

Alerting features 114, such as the reflective strips shown in FIGS. 5 and 6, are provided on the upright 118. The upright 118, although in FIG. 5 to have a substantially circular cylindrical shape, may comprise of only a semi-circular unit or single vane unit that fits into the base 116.

Furthermore, the semi-spherical member 116 has an outer face 121, which is bowl shaped and rounded and operatively partially in contact with the ground when laterally displaced. The semi-spherical member 116 further includes an inner face 123 with receiving means 125 to receive the upright 118. The receiving means 125 is in the form of an annular groove 125 defined within the semi-spherical member 116.

When the upright 118 is located within, and secured to, the groove 125 the body 112 is biased by biasing means 120 to remain in an upright position relative to the ground. Therefore, when impacted upon by strong winds or a vehicle, the location marker 100, can recover to its original upright or erect configuration after lapse of impact.

With the groove 125 being annular, it will be appreciated that the upright 118 has an elongate tubular shape complimentary to fit within the groove 125. Thus, as shown in FIG. 5, the tubular upright 118 includes a proximal end 127 disposed opposite a distal end 129. The proximal end 127 is operatively received within the groove 125. Further, an elongate gap 130 is defined between two side edges of the upright 118 that fail to come together to form a completed circle when viewed in cross section. As can be seen from the drawings, the gap 130 extends from the proximal end 127 to the distal end 129. This unique shape of the upright 118 allows multiple uprights 118 to be flexibly fitted within one another.

The semi-spherical member 116 may include a generally flat upper portion 132 flowing into a curved side wall that forms the outer face 121.

Figure 9:
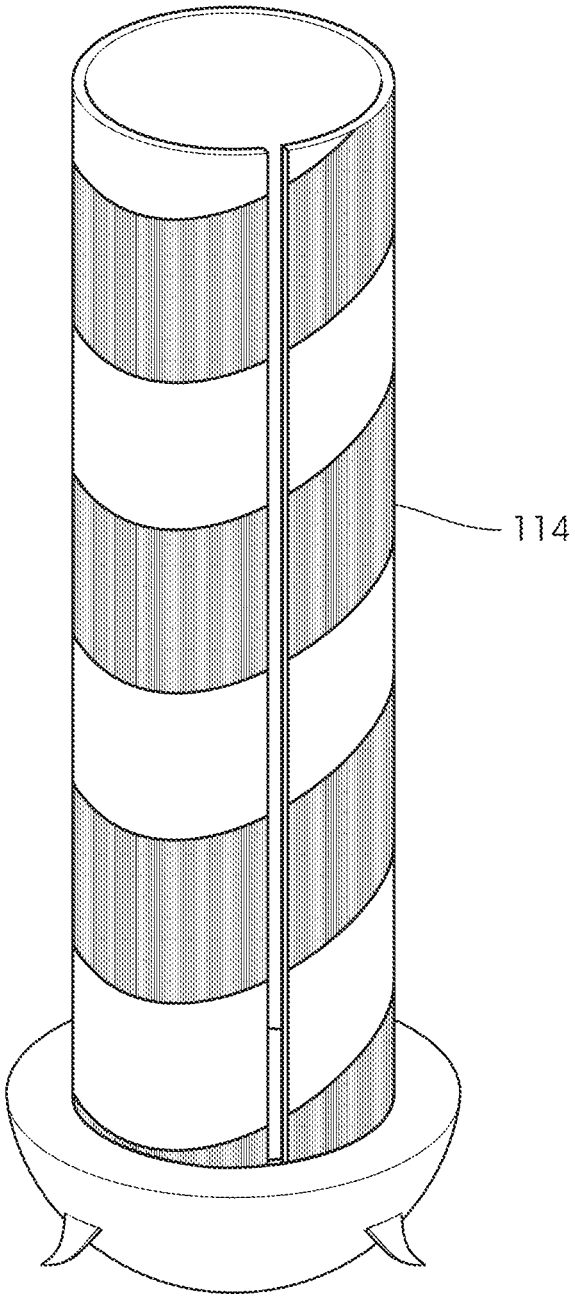
FIG. 9 shows a perspective view of the location marker of FIG. 5 with additional stabilizing means.

As shown in FIG. 9, the semi-spherical member 116 of the location marker 100 may also have stabilizing means such as three limbs 134 operatively mounted to, and radially extending from, the member 116 towards the ground. These limbs are preferably resilient and act to counter angular displacement of the upright 118 relative to the ground such that the upright 118 returns to its upright or erect position relative to the ground immediately after being angularly displaced. Moreover, the longitudinal axes of these limbs 134 may be equiangular relative to one another, and equal in length.

There is also provided for the semi-spherical member 116 to have a weighted centre of gravity provided either by inserting a weighted object into an internally located chamber (not shown) defined in the semi-spherical member, or by integrally forming the semi-spherical member, during manufacturing, with a weighted portion of sand, cement or the like. However, it will be appreciated that the semi-spherical member 116 may also be without additional weights, i.e. merely manufactured from a plastics material being heavier than the upright and provided with the four slantingly mounted legs acting as biasing means.

While preferred embodiments of the invention are shown and described, it will be understood that it is not intended to limit the extent of the invention, but rather it is intended to cover all modifications and alternate methods, including: methods, for manufacturing the location marker 10,100 falling within the spirit and the scope of the invention.

The applicant believes that the location marker 10,100 of the present invention, at least in part, addresses shortcomings in conventional location markers in that the location marker 10,100 provides a neat, sturdy and cost effective alternative which remains visible and effective as a location marker even after being temporarily knocked over by wind or a vehicle.

The location marker 10,100 of the present invention, furthermore eliminates the need for extra weighting such as sandbags or rocks which are often required to hold up ubiquitous delineators and location markers.

The subject matter for which protection is claimed is defined in the set of claims that follows hereinafter.

The invention claimed is:

1. A free-standing location marker having a normally upright erect orientation, comprising:

a body having an upright component and a base supporting said upright component from below, said upright component comprising a proximal lower end in proximity to said base, and a distal upper end opposed thereto, said proximal lower end being provided with engagement structure for defining an interference fit with receiving structure provided upon said base so as to be operatively connected to said base, an alerting feature so as to alert an observer or intended recipient about a message said alerting feature intends to convey when said upright component is disposed in said normally upright erect orientation, and a plurality of legs projecting radially outwardly from said base so as to effectively elevate said base above the ground and define a pivot point around which said location marker can move when said location marker is knocked over onto its side from said normally upright erect orientation so as to permit said location marker to automatically return to said normally upright erect orientation;

said base of said body including biasing structure comprising a mass substantially heavier that of said upright for causing said location marker to pivot around said pivot point in a direction opposite that in which said location marker was knocked over and thereby regain said normally upright erect orientation after being momentarily knocked over onto its side from said normally upright erect orientation.

2. The location marker of claim 1, wherein the base is square, when viewed in plan.

3. The location marker of claim 1, wherein each one of said plurality of legs comprises an outer edge portion which makes contact with the ground when said location marker is momentarily knocked over and during return of said upright to said normally upright erect orientation.

4. The location marker of claim 3, wherein said outer edge portion terminates in a tip adapted to be in touch with the ground when a distal end portion of said upright, opposite a proximal end portion of said upright connected to said base, touches the ground.

5. The location marker of claim 4, wherein the base comprises a mass between about 2.5 kg and about 8.5 kg.

6. The location marker of claim 5, wherein the base comprises an add-on fitment releasably secured to a center portion of the base, the fitment being configured to snuggly receive and locate an upright which comprises a smaller dimensioned upright than said at least one upright.

7. The location marker of claim 1, wherein said base further comprises beveled edges which define a perimeter around said base.

8. The location marker of claim 1, wherein the alerting feature is distinguishable and of clearly visible color, and is either integrally formed with, or applied to an outer surface of said upright, or comprises a reflective strip applied to said upright.

9. The location marker of claim 8, wherein said upright and said base are manufactured from a resilient material.

10. The location marker of claim 9, wherein said base comprises compressed rubber with a mass between about 5 kg and about 8 kg.

11. The location marker of claim 1, wherein said upright, base, and said plurality of legs are integrally formed and of unitary construction.

12. The location marker of claim 1, wherein said plurality of legs are mountable upon said base after separate manufacturing thereof.

13. The location marker of claim 1, wherein said upright has a frustoconical configuration with a hollow interior defined between side walls of said upright which are defined around a vertically oriented centerline of said upright.

14. The location marker of claim 1, wherein said upright comprises an elongate tubular sheet material with a hollow interior defined between side walls of said elongate tubular sheet material, wherein said hollow interior is defined around a centerline of said upright.

15. The location marker of claim 1, wherein said base comprises a semi-spherical member comprising a flat bottom surface which is disposed in contact with the ground when said location marker is disposed in said normally upright erect orientation, and an outer surface which is rounded and operatively in contact with the ground when said location marker is momentarily knocked over, and an inner face with receiving structure for receiving said upright.

16. The location marker of claim 15, wherein said receiving structure comprises at least one annular groove defined upon said inner face and partially within said semi-spherical member.

17. The location marker of claim 15, wherein said semi-spherical member comprises resilient stabilizing structure extending radially outwardly from said semi-spherical member towards the ground so that angular displacement of said upright relative to the ground is countered by said resiliency of said resilient stabilizing structure such that said upright automatically returns to said normally upright erect orientation relative to the ground immediately after being angularly displaced.

18. The location marker of claim 17, wherein said stabilizing structure comprises at least one resilient limb operatively mounted to, and extending radially outwardly from said semi-spherical member towards the ground.

19. The location marker of claim 18, wherein said at least one resilient limb comprises three limbs, the longitudinal axes of which are equiangularly spaced relative to one another, and are equal in length.

20. The location marker of claim 15, wherein said semi-spherical member has a weighted center of gravity comprising a weighted object disposed within a chamber defined within said semi-spherical member or by integrally forming said semi-spherical member with a weighted center of gravity.

* * * * *